United States Patent [19]

Aita

[11] Patent Number: 4,868,085

[45] Date of Patent: Sep. 19, 1989

[54] DEVELOPER FOR DEVELOPING ELECTROSTATIC IMAGES AND PROCESS FOR FORMING IMAGES

[75] Inventor: Shuichi Aita, Kawasaki, Japan

[73] Assignee: Canon Kabushiki Kaisha, Tokyo, Japan

[21] Appl. No.: 171,249

[22] Filed: Mar. 22, 1988

Related U.S. Application Data

[63] Continuation of Ser. No. 916,622, Oct. 8, 1986, abandoned, which is a continuation of Ser. No. 823,288, Jan. 28, 1986, abandoned.

[30] Foreign Application Priority Data

Jan. 31, 1985 [JP] Japan ..... 60-17067

[51] Int. Cl.[4] ..... G03G 13/22; G03G 21/00

[52] U.S. Cl. ..... 430/126; 430/125; 430/110; 430/111

[58] Field of Search ..... 430/110, 111, 125, 126

[56] References Cited

U.S. PATENT DOCUMENTS

| | | | |
|---|---|---|---|
| 3,983,045 | 9/1976 | Juble et al. | 430/110 |
| 4,082,681 | 4/1978 | Takayama et al. | 430/111 |
| 4,111,823 | 9/1978 | Kobayashi et al. | 430/110 |
| 4,533,614 | 8/1985 | Fukumoto et al. | 430/109 X |
| 4,626,487 | 12/1986 | Mitsuhashi et al. | 430/109 |

FOREIGN PATENT DOCUMENTS

| | | | |
|---|---|---|---|
| 52-46820 | 4/1977 | Japan | 430/110 |
| 53-147541 | 12/1978 | Japan | 430/110 |
| 56-128956 | 10/1981 | Japan | 430/110 |

*Primary Examiner*—Roland E. Martin

*Attorney, Agent, or Firm*—Fitzpatrick, Cella, Harper & Scinto

[57] ABSTRACT

A developer for developing electrostatic latent images comprises a toner comprising a colorant and a binder resin composed of a non-linear, low melting point polyester resin, inorganic fine powder A having BET specific surface area of 0.5–30 $m^2/g$ and inorganic fine powder B having BET specific surface area of 40–400 $m^2/g$ measured by means of nitrogen adsorption.

18 Claims, 1 Drawing Sheet

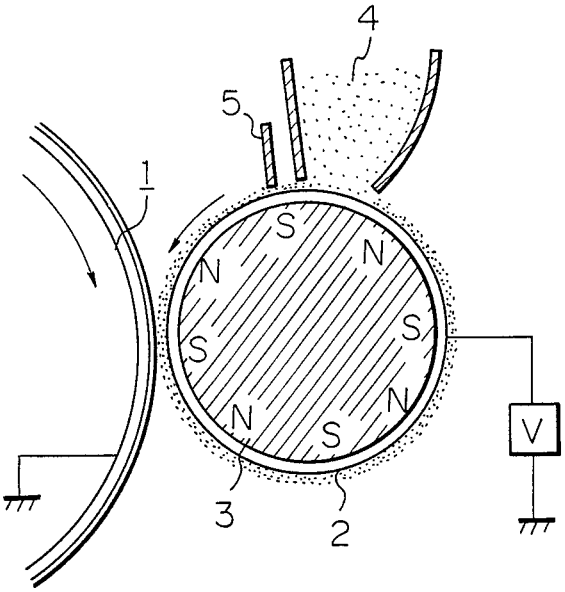
4
5
1
S
N
N
S
S
N
N
S
V
3
2

DEVELOPER FOR DEVELOPING ELECTROSTATIC IMAGES AND PROCESS FOR FORMING IMAGES

This application is a continuation of application Ser. No. 916,622, filed Oct. 8, 1986, now abandoned, which in turn is a continuation of application Ser. No. 823,288, filed Jan. 28, 1986, now abandoned.

BACKGROUND OF THE INVENTION

1. Field of the Invention

This invention relates to a novel toner used for image forming processes such as electrophotograph, electrostatic recording, magnetic recording and the like and in image forming processes using the same.

2. Description of Related Art

In the art of electrophotograph, properties of a photoconductive material such as cadmium sulfide, polyvinylcarbazole, selenium, zinc oxide and the like are utilized to form an electrostatic latent image. For example, electric charge is uniformly applied to a layer of photoconductive material; image exposure is then effected to form an electrostatic latent image; the latent image is subsequently developed by the use of toner particles having a charge of opposite polarity to that of the latent image (having a charge of identical polarity in the case of reversal development); and, if necessary, the image is transferred to a receiving sheet followed by fixing.

When an apparatus having a transfer step is employed, it is usual that the toner not transferred to a receiving sheet and remaining on the photosensitive member is removed and the photosensitive member is repeatedly used.

As the method for removing the toner remaining on a photosensitive member, there may be usually used a blade cleaning method, fur brush cleaning method, magnetic brush cleaning method, abrading roller cleaning method and the like. These methods are carried out by contacting the cleaning member with the photosensitive member. In these methods, the cleaning member is pressed to the photosensitive member at an appropriate pressure so that the photosensitive member is subjected to abrasion and the toner attaches fixedly to the photosensitive member while the cleaning member is used repeatedly. For example, Japanese Patent Application Laid-open No. 47345/1973 proposes that, for the purpose of avoiding the fixing of toner to a photosensitive member, both a friction decreasing material and an abradant material are added to a developer. Indeed, this proposal is effective to obviate the fixing of toner to a photosensitive member, but there still remains the following problem.

When the friction decreasing material is added in an amount enough for obviating the toner fixing phenomenon, materials of low electrical resistance such as paper powders, ozone addition product and the like can not be easily removed. These materials are formed on or attached to the surface of a photosensitive member while the photosensitive member is used repeatedly, and, in particular, latent images formed on the photosensitive member are markedly deteriorated by the materials of low electrical resistance under the conditions of high temperature and high humidity. The amounts of the friction decreasing material and the abradant material are so delicate that a toner of stable characteristics can be obtained with significant difficulty.

SUMMARY OF THE INVENTION

An object of the present invention is to provide a developer for development of electrostatic images capable of maintaining the surface of a photosensitive member in a good condition.

Another object of the present invention is to provide a developer having a durability for the copying of many sheets and having a long life.

Still another object of the present invention is to provide a developer having a low-temperature fixing property preferably applicable to a middle or high speed copying machine of 40 sheets per minute or more.

A further object of the present invention is to provide a developer improved in offset resistance.

A still further object of the present invention is to provide a developer giving a stable image density Another object of the present invention is to provide an image forming process using the aforesaid developer for development of electrostatic images.

According to one aspect of the present invention, there is provided a developer for developing electrostatic latent images which comprises:

a toner containing a colorant and a binder resin;

inorganic fine powder A having BET specific surface area determined by a nitrogen adsorption method of 0.5–30 $m^2/g$, and inorganic fine powder B having BET specific surface area determined by a nitrogen adsorption method of 40–400 $m^2/g$:

the binder resin being a non-linear, low melting point polyester resin prepared from components containing:

(A) a tricarboxylic or higher polycarboxylic acid contained in the acid component in an amount of 40 mole % or less and/or a trihydric or higher polyol contained in the alcohol component in an amount of 40 mole % or less, (B) a phthalic acid type compound having two carboxyl groups in the acid component in an amount of 60 mole % or more, and (C) an alkyl substituted dicarboxylic acid contained in the acid component in an amount of 30 mole % or less and/or an alkyl substituted diol contained in the alcohol component in an amount of 30 mole % or less, and (D) an etherified diphenol contained in the alcohol component in an amount of balance.

According to another aspect of the present invention, there is provided an image forming method where the above-mentioned developer is employed.

BRIEF DESCRIPTION OF THE DRAWINGS

The FIGURE is a cross-sectional view showing one embodiment of the developing process using the developer of the present invention.

DESCRIPTION OF THE PREFERRED EMBODIMENT

The toner used for the present invention is preferably an electrical insulating toner having a volume average particle size of about 2–30 $\mu$ an electrical resistivity of more than $10^{14}\Omega\cdot cm$ and capable of holding triboelectric charge.

In the present invention, as a binder resin for the toner, there is used a non-linear, low melting point polyester resin prepared from components containing:

(A) a tricarboxylic or higher polycarboxylic acid contained in the acid component in the amount of 40 mole % or less and/or a trihydric or higher polyol contained in the alcohol component in an amount of 40 mole % or less, (B) a phthalic acid type compound having two carboxyl groups in the acid component in an amount of 60 mole % or more, and (C) an alkyl substituted dicarboxylic acid contained in the acid component in an amount of 30 mole % or less and/or an alkyl substituted diol contained in the alcohol component in an amount of 30 mole % or less, and (D) an etherified diphenal contained in the alcohol component in an amount of balance.

The above defined polyester resins preferably have an acid value of 2–60, more preferably 5–40, and this condition serves to have charge controllability and offset resistance for a hot-press roller. Toners with binders of the above defined resins produce less stain on the surface of a photosensitive member by fusing adhesion, and have excellent properties in flowability, antihygroscopicity and friction electrification property with negative charge. The non-linear, low melting point polyester resins having crosslinked structures have a higher coefficient of elasticity than usual polyester resins, and thus, in the blade cleaning method or the abrading roller cleaning method where the contacting pressure of a cleaning member with a photosensitive member is high, the friction coefficient between the cleaning member and the photosensitive member is liable to be excessively high resulting in the flawing of the surface of the photosensitive member. The developer of the present invention is considered to have a more excellent inhibiting property for the toner fixing phenomenon when the toner is mixed with inorganic fine powders having a BET specific surface area determined by nitrogen adsorption of 0.5–30 $m^2/g$, preferably 0.8–15 $m^2/g$, more preferably 1.0–6.0 $m^2/g$ and inorganic fine powders having the specific surface area of 40–400 $m^2/g$, preferably 50–350 $m^2/g$, more preferably 70–300 $m^2/g$.

The inorganic fine powder having a BET specific surface area determined by nitrogen adsoprtion of 0.5–30 $m^2/g$ (hereinafter referred to fine powder A) and the inorganic fine powder of 40–400 $m^2/g$ (hereinafter referred to fine powder B) both have a function of abrading low electrical resistence materials such as paper powder, ozone addition products and the like and a toner which adheres to the surface of a photosensitive member. Particularly, fine powder A effectively acts to form a fine uniformity on the surface of a photosensitive member as to not interfere in the forming an electrostatic latent image and thereby reduce the friction resistence between the surface of a photosensitive member and a cleaning member resulting in the prevention from toner fixing. Fine powder B has effect on the removal of fine adhesives on the surface of a photosensitive member. In the present invention, friction reducing materials are not necessarily required, and a developer having a stable characteristic can be obtained. The reason why specific surface areas of fine powders A and B must be within the aforementioned range is that the aforesaid effects are otherwise reduced.

Preferably, fine powder A is not readily soluble in water in order not to reduce the electrification characteristic of a toner. Examples of fine powder A include titanate compounds such as calcium titanate, strontium titanate, barium titanate, magnesium titanate and the like and compositions containing said compounds as the primary constituent (more than 50 wt.%) pulverized after granulation. The preferred titanate compounds have a dielectric constant (determined at a temperature of 25° C. and a frequency of 1000 Hz) of 150 or more, preferably 200–400, in order to properly act on toner particles to enhance the image density. For example, titanate compounds can be prepared by calcination or firing after mixing titanium oxide with strontium carbonate, barium carbonate, calcium carbonate or magnesium carbonate. It is preferred that the titanate compound has a volume average particle size of half or less of that of the toner particles, i.e. 0.1–5 $\mu$, preferably 0.5–3$\mu$, in view of the relation to the toner particles and fine powder B.

In addition, it is preferred that fine powder A has a hardness greater than that of the surface of the photosensitive member, and, in particular, higher than a Mohs scale of 1 (the hardness of talc).

It is preferred that fine powder B is not readily soluble in water. Example thereof include inorganic compounds, for example, silicic acid fine powders, that is, silica or silicate fine powder.

Preferred fine powder B is a hydrophobic and negatively chargeable silicic acid fine powder treated with a silane coupling agent such as demethyldichlorosilane. As the silicic acid fine powder, a silicic acid fine powder prepared by dry process or wet process can be used.

The dry process in this context is a process for preparing silica fine powder by oxidation of halogenated silicon compounds in a vapor phase. For example, the pocess utilizing a thermal decomposition and oxidation reaction of silicon tetrachloride gas in oxyhydrogen flame is as follows:

$$SiCl_4+2H_2+O_2\rightarrow SiO_2+4HCl$$

In this preparing step, other halogenated metal compounds such as aluminum chloride, titanium chloride and the like can be used together with the halogenated silicon compounds to obtain a fine powder mixture of silica and other metal oxides. This procedure is included in the present invention.

As the wet process, various known processes are applicable. For example, the process of acid decomposition of sodium silicate is as follows:

$$Na_2O\surd xSiO_2+HCl+H_2O\rightarrow SiO_2\cdot nH_2O+NaCl$$

In addition, there are a method of decomposition of sodium silicate with ammonium salts or alkali metal salts, a process of preparing alkali earth metal silicates from sodium silicate followed by acid decomposition to obtain silica, a process of preparing silica from a sodium silicate solution by the use of ion exchange resin, and a process utilizing natural silica or silicates.

Silicic acid fine powder to be used includes anhydrous silicon dioxide (silica) and silicates such as aluminum silicate, sodium silicate, potassium silicate, magnesium silicate, zinc silicate and the like.

It is preferred that the surface of the silicic acid fine powder is subjected to coupling treatment, oil treatment or the treatment with aliphatic acids or metal salts of aliphatic acids.

Those fine powders A and B may be present on the surface of toner particles, and preferably, they are used by mixing with toner particles. Added amount of fine powder A is preferably 0.1–30 wt. % (more preferably 0.2–10 wt.%) based on the aount of toner, and added amount of fine powder B is preferably 0.01–20 wt.% (more preferably 0.03–5 wt.%) based on the amount of toner for favorable results.

The surface of fine powders A and B may be treated with known organic coupling agents such as titanium coupling agents, silane coupling agents and the like.

In this invention, measurements of BET specific surface area by nitrogen adsorption were performed under suitable conditions by the use of a commercial apparatus (model 2200, manufactured by Micromeritics Co.). When the specific surface area exceeds 200 $m^2/g$, the number of samples was reduced.

In the present invention, polyester resins as the toner binding resin having an acid value of 2–60 and a weight average molecular weight (Mw) of 10,000 or more, preferably 20,000–70,000, are preferred in respect of development characteristics and offset resistance property. Polyester resins of the present invention are constituted of dicarboxylic acids represented by phthalic acid and polycarboxylic acids primarily as the acid component and etherified diphenol mixtures primarily as the alcohol component.

The polyester resin used in the present invention may be produced by mixing predetermined amounts of the acid component and the alcohol component and heating at 150°–270° C., preferably 200°–260° C., to effect dehydration. Reaction is stopped when the acid value of the product becomes 2–60.

In particular, the etherified diphenols are primarily constituted of propoxylated bisphenols and partly mixed with ethoxylated bisphenols. In addition, they contain alkylsubstituted dicarboxylic acids and/or alkyl-substituted diols as special components. Said alkyl-substituted dicarboxylic acids are dicarboxylic acids having alkyl groups, and said alkyl-substituted diols are diols having alkyl groups.

As the phthalic acid type compound having two carboxyl groups used as a primary constituting material of polyesters, there can be used 1,2-benzenedicarboxylic acid and the anhydride thereof, 1,3-benzenedicarboxylic acid, 1,4-benzendicarboxylic acid and the esterified products thereof. The phthalic acid type compounds are preferably added to the acid component of polyester resin in an amount of 60–89 mole % (calculated based on the starting material). Aliphatic dicarboxylic acids may be contained in the dicarboxylic acids in an amount of less than 40 mole %. Examples of the aliphatic or alicyclic dicarboxylic acids include fumaric acid, maleic acid, succinic acid, cyclohexanedicarboxylic acid, malonic acid, glutaric acid and the anhydrides thereof.

As the etherified diphenol, there may be used, for example, polyoxyethylene (6)-2, 2-bis(4-hydroxyphenyl) propane, polyhydroxybutylene (2)-2, 2-bis(4-hydroxyphenyl) propapne, polyoxyethylene (3)-2, 2-bis(4-hydroxyphenyl) propane, polyoxypropylene (3)-bis(4-hydroxyphenyl) thioether, polyoxyethylene (2)-2, 6-dichloro-4-hydroxyphenyl-2',3',6'-trichloro4'-hydroxyphenyl methane, polyoxypropylene (3)-2-bromo-4-hydroxyphenyl 4-hydroxyphenyl ether, polyoxyethylene (2,5)-p, p-bisphenyl, polyoxybutylene (4)-bis(4-bydroxyphenyl) ketone, polyoxstyrene (7)-bis(4-hydroxyphenyl) ether, polyoxypentylene (3)-2, 2-bis(2,6-diiodo-4-hydroxyphenyl) propane, and polyoxypropylene (2,2)-2, 2-bix(4-hydroxyphenyl) propane.

Preferable etherified diphenols are etherified bisphenols. Preferable etherified bisphenols are those in a form of ethoxy or propoxy and having 2 or 3 moles of oxyethylene or oxypropylene per one mole of bisphenol, and having propylene or sulfone group for connecting two phenol groups.

Examples of such etherfied bisphenols are polyoxyethylene (2,5)-bis(2,6-dibromo-4-hydroxyphenyl) sulfone, polyoxypropylene (3)-2, 2-bis(2,6-difluoro4-hydroxyphenyl) propane and polyoxyethylene (1,5)-polyoxypropylene (1.0)-bis(4-hydroxyphenyl) sulfone.

Other preferable etherified bisphenols are, for example, polyoxypropylene-2, 2'-bis(4-hydroxyphenyl) propane, and polyoxyethylene or polyoxypropylene2, 2-bis(4-hydroxy-2, 6-dichlorophenyl) propane (the number of oxyalkylene unit per one mole of bisphenol being 2.1–2.5). It is preferable that the etherified diphenol is contained in the alcohol component (based on the starting material) of the polyester in an amount of 50–100 mole %.

As the tricarboxylic or higher polycarboxylic acids, there may be enumerated, including esters thereof, 1,2,4-benzene tricarboxylic acid, 1,2,5-benzene tricarboxylic cid, 1,2,4-cyclohexane tricarboxylic acid, 2,5,7-naphthalene carboxylic acid, 1,2,4-naphthalene tricarboxylic acid, 1,2,4-butane tricarboxylic acid, 1,2,5-hexane tricarboxylic acid, 1,3-dicarboxyl-2-methylenecarboxyl propane, 1,3-dicarboxyl-2-methyl-2-methlenecarboxyl propane, tetra(methylenecarboxyl) methane, and 1,2,7,8-octane tetracarboxylic acid. Preferable polycarboxylic acid composition is that containing at least 60 mole % trimellitic acid, pyromellitic acid and/or anhydride thereof.

As the trihydric or higher polyols, there may be used polyhydroxy compounds having 3–12 carbon atoms and 3–9 hydroxyl groups. Preferable polyhydroxy compounds are sugar alcohols and anhydrides thereof.

Examples of the polyhydroxy compounds are sorbitol, 1,2,5,6-hexane tetrol, glycerine, 1,4-sorbitan, pentaerythritol, xylitol, sucrose, 1,2,4-butanetriol, 1,2,5-pentanetriol, erythro-1,2,3-butanetriol and threo-1,2,3-butanetriol. Preferable polyol component contains at least 60 mole % of a member selected from glycerine, pentaerythritol, and sorbitol.

The content of the tricarboxylic or higher polycarboxylic acid in the acid component should not exceed 40 mole % and the content of the trihydric or higher polyol should not exceed 40 mole % in the alcohol component.

According to the present invention, it is preferable that the tricarboxylic or higher polycarboxylic acid is contained in the acid component (based on the starting material) of the polyester resin in an amount of 10–30 mole %.

As the alkyl substituted dicarboxylic acid, there may be used, for example, succinic acid, maleic acid, fumaric acid and acid anhydride thereof substituted with an alkyl group having 6–18 carbon atoms. The alkyl substituted succinic acid, maleic acid and fumaric acid may be represented by the following formulas:

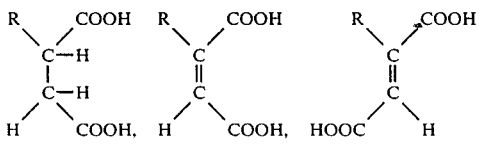

where R is alkyl having 6–18 carbon atoms.

As the alkyl substituted diols, there may be used glycols substituted with an alkyl group having 6–18 carbon atoms. Particularly, ehtylene glycol having alkyl of 6–18 carbon atoms is preferable.

To the developer, according to the present invention there may be added, if desired, an addivitve as far as the additive does not adversely affect the characteristics of toner. As additives, there may be used a lubricant such as Teflon, zinc stearate, polyvinylidene fluoride and the like, a fixing auxiliary agent such as slow molecular weight polyethylene and low molecular weight polypropylene, and an electroconductivizing agent such as tin oxide and the like.

As the charge controlling agent for the toner according to the present invention, there may be used organic salts or complexes containing a metal of divalency or higher. As effective metal species, there may be mentioned polyvalent metals such as Al, Ba, Ca, Cd, Co, Cr, Cu, Fe, Hg, Mg, Mn, Ni, Pb, Sn, Sr, Zn and the like.

As the organic metal compound, there may be effectively used carboxylic acid salts, alkoxylates, organic metal complexes and chelate compounds of the above-mentioned metals. Examples of the organic metal compounds are zinc acetate, magnesium acetate, calcium acetate, aluminum acetate, magnesium stearate, calcium stearate, aluminum stearate, aluminum isopropoxide, aluminum acetyl acetate, iron (II) acetylacetonate, chromium 3,5-ditertiary-butyl stearate, and chromium or zinc 3,5-ditertiary-butyl salicylate. In particular, negative charge controlling and thermally decomposable acetylacetone metal complexes and metal salts of salicylic acid series are preferable. The amount of the charge controlling agent is preferably 0.2–4 % by weight based on the binder resin so as to adjust suitably the triboelectric chargeability. At the amount less than 0.2 % by weight the substantial advantageous effect decreases.

Other resins may be incorporated into the toner as far as the effect of the present invention is not adversely affected.

If desired, the following resins may be contained in the binder resin in an amount of not more than 40 % by weight: polyester resins, urethane resins, epoxy resins, ethylene-ethyl acrylate resin, phenolic resins, styrene-butadiene resins, xylene resins, butyral resins and the like.

It is more preferable that the content of the above-mentioned resins in the binder resin for toner does not exceed 20 % by weight. Among the resins, styrene-acrylic resins are preferable.

As the coloring agent for the developing agent according to the present invention, there may be used known dyes and pigments such as carbon black, phthalocyanine blue, indanthrene blue, peacock blue, permanent red, lake red, rhodamine lake, Hanza yellow, permanent yellow, and benzidine yellow.

Magnetic powders may be added to the developing agent of the present invention when the developing agent is used as a magnetic toner. The magnetic powders can also function as coloring agent. As the magnetic powders, there may be used materials capable of being magnetized in a magnetic field. Examples of such materials are powders of ferromagnetic metals such as iron, cobalt, nickel, and the like, and alloys and compounds such as magnetite, $\gamma$-iron oxide, ferrite and the like. The amount of magnetic powders is preferably 15–70 % by weight based on the weight of toner.

If desired, the toner may be mixed with carrier particles such as iron powders, glass beads, nickel powders, ferrite powders and the like, and used as a developing agent for electrostatic latent images.

As a photosensitive member to which the developing agent according to the present invention is applied, there may be mentioned a photosensitive member having an organic polymer layer (e.g. a laminate type organic photoconductive photosensitive member) on the surface and that made of amorphous Se, amorphous Si, zinc oxide, or the like. In particular, a photosensitive member having an organic polymer layer on the surface and an amorphous Si photosensitive member having an SiC layer on the surface are preferable. The thickness of the SiC layer as a protective layer is preferably 1000–10000 Å.

The toner according to the present invention may be used for various developing methods, for example, magnet brush developing method, cascade developing method, a developing method using electroconductive magnetic toners desclosed in U.S. Pat. No. 3,909,258, a developing method using a highly resistive magnetic toner disclosed in Japanese Patent Application Laid-open No. 31136/1978, developing methods disclosed in Japanese Patent Application Laid-open Nos. 42121/1979, 18656/1980, and 43027/1979, fur brush developing method, powder cloud method, touch down developing method and impression developing method.

As a cleaning method used in the present invention, there may be mentioned, for example, a blade cleaning method where a blade made of an elastic member such as urethane rubber, silicone rubber, fluorine rubber, polyethylene rubber and the like is used, a rubbing roller cleaning method using a roller having an elastic member as mentioned above, and a method of combination of the blade cleaning and the rubbing roller.

The inorganic fine powders used in the present invention are produced, for example, by a sintering method. In the following, preparation examples of inorganic fine powders are polyester resins are shown.

PREPARATION EXAMPLE 1

Strontium carbonate 147.6 g and titanium oxide 79.9 g were mixed under a wet condition for 8 hours by means of a ball mill, filtered and dried. 20 g of the resulting mixture was shaped at a pressure of 5 kg/cm$^2$ and heated at 1100° C. for 8 hours followed by mechanical pulverization to produce finely divided strontium titanate having a BET specific surface area of 2.4 m$^2$/g, volume average particle size of about 1.1 $\mu$ and dielectric constant of 220.

PREPARATION EXAMPLE 2

Barium carbonate 197.3 g and titanium oxide 79.9 g were mixed under a wet condition for 8 hours by means of a ball mill, filtered and dried. The resulting mixture 20 g was shaped at 5 kg/cm$^2$ and heated at 1200° C. for 8 hours, followed by mechanical pulverization to give barium titanate having BET specific surface area of 3.0 m$^2$/g, volume average particle size of 0.95 $\mu$ and dielectric constant of 300.

PREPARATION EXAMPLE 3

545 parts by weight of polyoxypropylene (2,5)- 2,2-bis(4-hydroxyphenyl) propane was placed in a four-necked flask, which was then equipped with stirrer, condenser, thermometer and gas inlet pipe and put on a mantle heater. The reaction vessel was purged with nitrogen gas and the temperature of the content was raised to 50°–60° C., and then terephthalic acid 135 parts by weight, succinic acid substituted with $C_{12}$ alkyl group ($C_{16}H_{30}O_4$, the structural formula being $C_{12}H_{25}-CHCOOH$
$\quad\quad\quad\quad\quad\quad|$
$\quad\quad\quad\quad\quad CH_2COOH.)$ 77 parts by weight and trimellitic acid 38 parts by weight were added and as the result, 0.9 equivalent of carboxy group was present for 1 equivalent of hydroxyl group.

The resulting mixture was heated with stirring at 210° C. for about 5 hours while removing the water formed by reaction, and after 5 hours, the acid value was measured every one hour so as to find the end point of the reaction. When the acid value became 30, the reaction mixture was cooled to room temperature to stop the reaction. The resulting polyester resin had a weight average molecular weight of about 30,000.

PREPARATION EXAMPLE 4

Following the procedure of Preparation Example 3, 545 parts by weight of polyoxypropylene (2,5)-2,2-bis(4-hydroxyphenyl) propane was placed in a flask and then the flask was purged with nitrogen gas, followed by heating at 50° C. To the flask were added 135 parts by weight of isphthalic acid, 77 parts by weight of succinic acid substituted with a $C_{12}$ alkyl group, and 38 parts by weight of trimellitic acid, and the resulting mixture was heated with stirring at 210° C. to cause the reaction and after completion of the reaction, the mixture was cooled to room temperature. The resulting polyester resin had acid value of about 20 KOH mg/g and weight average molecular weight of about 70,000.

Upon preparing the toner of the present invention, there may be used various methods, for example, a method comprising sufficiently mixing and kneading the components by means of a thermal mixing and kneading machine such as heat roll, kneader, extruder and the like and mechanical pulverization and classification, a method comprising dispersing materials such as magnetic powders and the like in a solution of a binder resin and then spray-drying, and a method for producing a toner comprising mixing a monomer forming a binder resin with a polyester resin of the present invention and a predetermined material and subjecting the resulting mixture to a suspension polymerization.

According to the present invention, it is preferable that a thermally decomposable (for example, gradually decomposing at a temperature of 100° C. or higher) organic metal complex is used as a charge controlling agent and the cross-linked polyester resin is further cross-linked upon melt-mixing and kneading.

The following examples are given for the purpose of illustration and not by way of limitation. The parts are by weight.

EXAMPLE 1

| | |
|---|---|
| Polyester resin of Preparation Example 4 | 100 parts |
| Chromium 3,5-ditertiary-butyl salicylate | 3 parts |
| Magnetite (particle size 0.1 μ) | 60 parts |

The above-mentioned ingredients were mixed and melt-kneaded by a roll mill. After cooling, the product was roughly ground by a hammer mill and then finely divided by a jet pulverizer, followed by classification using a wind classifying machine to produce colored fine powders (toner particles) of 5–20 μ in size. The resulting toner had volume resistivity of about $10^{15}$ ohm.cm. 100 parts of the colored fine powders was mixed with 3 parts of fine powders of strontium titanate having a specific surface area of 2.4 $m^2/g$ as prepared in Preparation Example 1 and 0.4 part of hydrophobic negatively chargeable colloidal silica (specific surface area of 90 $m^2/g$ to produce a developing agent. The resulting developer was measured by a blow-off method and found to have a triboelectric charge of −12.2 μC/g. Development was effected by using a developing device as shown in the drawing. An a-Si photosensitive drum 1 was constituted of three layers, that is, an aluminum substrate, a charge injection preventing layer of 1.0 μ thick and an a-Si (amorphous silicon) photoconductive layer containing boron. The surface of the a-Si photosensitive drum 1 was uniformly charged by +6 kV corona discharging at a line surface speed of 168 mm/sec of the drum and subjected to imagewise exposure to form latent images on the surface of the photosensitive member.

Development of the latent images was effected with the above-mentioned developer 4 by using a developing device constituted of a sleeve of 50 mm in dia. containing magnet 3, having a sleeve surface magnetic flux density of 700 gauss, the distance between an iron blade controlling the toner layer thickness 5 and an aluminum sleeve 2 being 0.2 mm, and the distance between the surface of the a-Si photosensitive drum and the sleeve was kept 0.25 mm. Then, the resulting toner images were transferred to a receiving paper while a +7 kV DC corona was applied to the back side of the receiving paper and fixed by passing between heat-pressing rollers (surface temperature of about 160° C.). As a cleaning means, there was used a rubbing cleaning.

The rubbing roller was constituted of a metal shaft, an inner layer composed of silicone sponge and an outer layer composed of a solid silicone rubber, had a hardness of 40° (measured according to ASKER C), and was press-contacted with the a-Si photosensitive drum at a total pressure of 1.5 kg.

Thus clear and fogless images having image density of 1.39 were obtained. Running tests of copying 100,000 sheets were conducted at ordinary temperature and ordinary humidity (20° C., 60 %), low temperature and low humidity (15° C., 10 %), or high temperature and high humidity (30° C., 90 %), and good images were obtained at each of the above-mentioned conditions. There were not formed irregular images and fog due to fixing of toner to the surface of the photosensitive member.

EXAMPLE 2

| | |
|---|---|
| Polyester resin of Preparation Example 3 | 100 parts |
| Chromium 3,5-ditertiary-butyl salicylate | 3 parts |
| Magnetite | 50 parts |

By using the above-mentioned ingredients and following an ordinary procedure, there were obtained colored fine powders (toner particles) of average particle size of 10 μ. 100 parts of the resulting toner was mixed with 1 part by weight of barium titanate obtained by Preparation Example 2 and 0.4 part of hydrophobic negatively chargeable colloidal silica (specific surface area of 90 $m^2/g$) to produce a developing agent. The resulting developer had a triboelectric charge of −13.0 μC/g according to a blow-off method. The developer was used in a way similar to Example 1 to produce images similar to those in Example 1 having image density of 1.35, and further, the durability was also excellent.

EXAMPLE 3

The developer of Example 1 was applied to a commercially available copying machine (NP-400 RE, tradename, manufactured by Canon K.K.) and running tests of copying 10,000 sheets were carried out under various conditions such as ordinary temperature and ordinary humidity, low temperature and low humidity, high temperature and high humidity, and the like. Good images were produced under each condition.

COMPARISON EXAMPLE 1

Repeating the procedures of Example 1 except that a styrene-acrylic resin (copolymerization weight ratio of 85:15 and weight average molecular weight of about 350,000) was used, the resulting developer was used for copying 20,000 sheets and the resulting image quality became worse than that in Example 1. The image density was 1.0 and low temperature offset phenomenon was observed.

COMPARISON EXAMPLE 2

Repeating the procedures of Example 1 except that strontium titanate produced in Preparation Example 1 was not used, the resulting developer was used for the running test at high temperature and high humidity, and as a result, images having image density of about 1.2 were obtained at the beginning, but deteriorated matters such as oxides formed by the action of ozone and the like gradually accumulated on the surface of the amorphous Si photosensitive member, and image flow occurred.

What is claimed is:

1. An image forming method which comprises developing electrostatic latent images formed on a latent image bearing member by means of a developer, wherein the latent image bearing member is an amorphous silicon photsensitive member; transferring the toner images thus developed on the latent image bearing member to a receiving member; fixing the transferred toner images on the receiving member; and cleaning the developer remaining on the latent image bearing member by means of a blade and/or a rubbing roller made of an elastic material; wherein the developer comprises:
   (a) a toner containing a colorant and a binder resin;
   (b) an inorganic fine powder A of a titanate compound having BET specific surface area determined by a nitrogen adsorption method of 0.8 to 15 $m^2/g$, and
   (c) an inorganic fine powder B having BET specific surface area determined by a nitrogen adsorption method of 50 to 350 $m^2/g$, provided that the inorganic fine powder B is not same as the inorganic fine powder A; wherein the binder resin is a non-linear, low melting-point polyester resin prepared from components containing:
      (i) a tricarboxylic or higher polycarboxylic acid contained in the acid component in an amount of 40 mole % or less and/or a trihydric or higher polyol contained in the alcohol component in an amount of 40 mole % or less,
      (ii) a phthalic acid type compound having two carboxyl groups in the acid component in an amount of 60 mole % or more,
      (iii) an alkyl substituted dicarboxylic acid contained in the acid component in an amount of 30 mole % or less and/or an alkyl substituted diol contained in the alcohol component in an amount of 30 mole % or less, and
      (iv) the balance being an etherified diphenol contained in the alcohol component.

2. The image forming method according to claim 1, in which the developer is cleaned by means of a rubbing roller made of an elastic material.

3. The image forming method according to claim 2, in which the rubbing roller has an outer layer composed of a solid silicon rubber.

4. The image forming method according to claim 1, in which the inorganic fine powder A has BET specific surface area determined by a nitrogen adsorption method of 1.0 to 6.0 $m^2/g$ and the inorganic fine powder B has BET specific surface area determined by a nitrogen adsorption method of 70 to 300 $m^2/g$.

5. The image forming method according to claim 4, in which the inorganic fine powder A is contained in an amount of 0.2 to 10 wt. % based on the amount of the toner and the inorganic find powder B is contained in an amount of 0.03 to 5 wt. % based on the amount of the toner.

6. The image forming method according to claim 5, in which the inorganic fine powder A comprises strontium titanate.

7. The image forming method according to claim 5, in which the inorganic fine powder A comprises barium titantate.

8. The image forming method according to claim 5, in which the inorganic fine powder B comprises a hydrophobic negatively chargeable colloidal silica.

9. The image forming method according to claim 1, in which the tricarboxylic or higher polycarboxylic acid is contained in the acid component in an amount of 10 to 30 mole %.

10. The image forming method according to claim 1, in which the phthalic acid type compound having two carboxyl groups is contained in the acid component in an amount of 60 to 89 mole %.

11. The image forming method according to claim 1, in which the alkyl substituted dicarboxylic acid is contained in the acid component in an amount of 1 to 30 mole %.

12. The image forming method according to claim 11, in which the alkyl substituted dicarboxylic acid is selected from aliphatic dicarboxylic acids having an alkyl group having 6 to 18 atoms.

13. The image forming method according to claim 12, in which the alkyl substituted dicarboxylic acid is selected from the group consisting of succinic acid, maleic acid, fumaric acid and anhydrides thereof.

14. The iamge forming method according to claim 11, in which the alkyl substituted diol is selected from diols having an alkyl group having 6 to 18 carbon atoms.

15. The image forming method according to claim 1, in which the etherified diphenol is contained in the alcohol component in an amount of 50 to 100 mole %.

16. The image forming method according to claim 1, in which the inorganic fine powder A has a dielectric constant of 150 or more.

17. The image forming method according to claim 1, in which the inorganic fine powder A has a volume average particle size which is ½ times or less that of the toner and the volume average particle size is 0.1 to 5.0 μ.

18. The image forming method according to claim 8, in which the inorganic fine powder B is hydrophobic negatively chargeable silica treated with a silane coupling agent.

* * * * *